United States Patent [19]

McReynolds

[11] 4,278,025

[45] Jul. 14, 1981

[54] SEISMIC EXPLOSIVE CHARGE LOADER AND ANCHOR

[76] Inventor: Oliver B. McReynolds, 913 N. Perry St., Palestine, Tex. 75801

[21] Appl. No.: 11,459

[22] Filed: Feb. 12, 1979

[51] Int. Cl.[3] ..... F42B 3/20

[52] U.S. Cl. ..... 181/116; 102/319; 102/530; 285/391

[58] Field of Search ..... 102/21.8, 24 R; 285/391, 260

[56] References Cited

U.S. PATENT DOCUMENTS

| | | | |
|---|---|---|---|
| 1,372,238 | 3/1921 | Kreiter | 285/391 X |
| 2,366,067 | 12/1944 | Smith | 285/260 X |
| 2,673,751 | 3/1954 | Finch | 285/391 X |
| 3,185,092 | 5/1965 | Hamilton | 102/24 R |
| 3,186,340 | 6/1965 | Foster | 102/24 R |
| 3,280,742 | 10/1966 | Babb | 102/21.8 |
| 3,285,172 | 11/1966 | Foster | 102/24 R |
| 3,285,173 | 11/1966 | Hamilton | 102/24 R |
| 3,376,816 | 4/1968 | Foster et al. | 102/24 R |
| 3,813,115 | 5/1974 | French | 285/391 X |
| 3,939,771 | 2/1976 | McReynolds | 102/21.8 |

*Primary Examiner*—David H. Brown

*Attorney, Agent, or Firm*—James F. Weiler; Dudley R. Dobie, Jr.; William A. Stout

[57] ABSTRACT

An improved seismic explosive charge loader and anchor for loading and anchoring explosives in cylindrical containers in bore holes is disclosed, which includes a snap in spring band shaped anchor which effectively anchors the loader in the well bore against upward movement, one aspect of the invention includes a snap lock threaded connection for securing an explosive container having interrupted threads to the loader and anchor, and the loader and anchor is constructed and arranged to maintain a detonator in place in the explosive container thereby assuring detonation of the explosive.

12 Claims, 8 Drawing Figures

Fig. 5
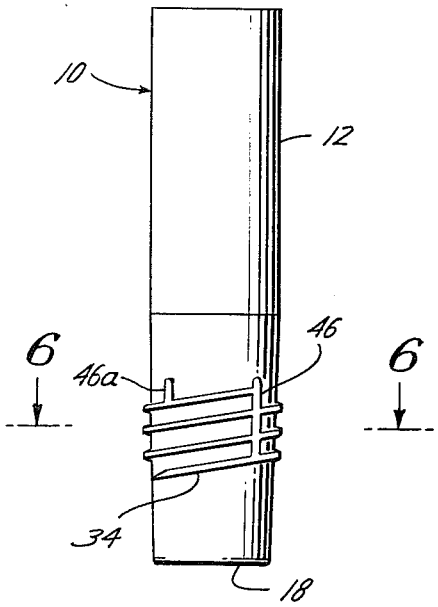
Fig. 6
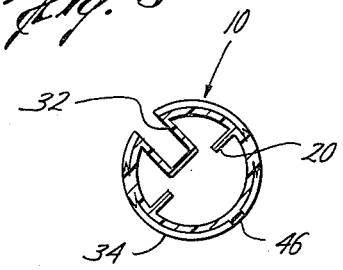
Fig. 8
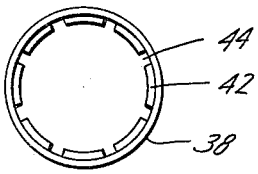
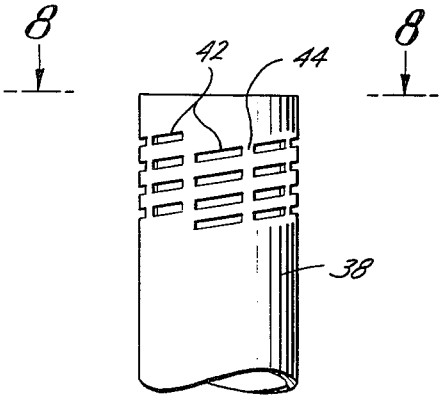
Fig. 7

SEISMIC EXPLOSIVE CHARGE LOADER AND ANCHOR

BACKGROUND OF THE INVENTION

In geophysical exploration, boreholes are drilled to different depths, explosive charges are placed and anchored in them at suitable depths and then exploded to produce reflected sound waves which are detected by geophones which identify particular waves and time the length of travel from the reflected source. Of major concern in geophysical exploration is the placement and anchoring of explosive seismic charges at desired depths in the boreholes and the prevention of malicious and unauthorized removal of the explosives from the boreholes.

Also of major concern is securely locking the explosive charge to an anchoring device and providing the anchoring device with great stability in anchoring the explosive charge in the borehole.

Also of major concern is insuring that the explosive charge is detonated in the well bore and not left therein in unexploded condition.

Commercially available explosive charges at the present are packed in several types of containers. One of the popular type of containers is an enlongated cylindrical container which has a pin and box with interrupted threads so that the containers can be secured to another in end to end relation to form a charge of desirable length. There are other types of containers for explosive charges on the market and in general, these are all contained in cylindrical containers.

Patent art relating to seismic explosive cartridge units, loading and anchoring adapters, and the like include: U.S. Pat. Nos. 2,535,196; 3,280,742; 3,075,424; 3.046,886; 3,150,590; 3,208,381; and 3,939,771. A loader is also sold to the trade by specialties for industries such as Jackson, Miss., under U.S. Pat. No. 3,280,742. In addition, seismic explosive charge loaders have been used in the trade by the inventor under U.S. Pat. No. 3,939,771 in various forms prior to the invention hereof.

The foregoing anchors and loaders for explosive charges in seismic exploration have not been entirely satisfactory, however, particularly because of unauthorized and malicious removal of explosive charges from shotholes, the need to insure detonation of the explosive charge and the need for greater stability in securely locking the anchor and loader to the container for the explosive charge as well as providing greater stability in anchoring the charge in the shothole thereby making it very difficult to remove the charge from the borehole.

SUMMARY OF THE INVENTION

The present invention is directed to a seismic explosive charge loader and anchor which advantageously can be used for securely locking the loader and anchor to the cylindrical container housing the explosive charge, one which maintains the detonator or blasting cap in place in the explosive charge and one in which great stability is provided in anchoring the explosive charge to the earth wall formation of the borehole thereby making it very difficult to remove the explosive charge from the borehole and preventing floating charges in the borehole.

More particularly, the present invention is directed to an improved seismic explosive charge loader and anchor for loading and anchoring in a borehole an explosive charge in a cylindrical container. The loader and anchor has a generally tubular body open at its upper end providing an upwardly facing recess of sufficient internal diameter to loosely receive a loading pole or other weight means. Upwardly facing stop means extend inwardly of the tubular body intermediate its ends and transversely opposed slots are provided in the body adjacent to the stop means.

A spring band shaped anchor having a central portion with arms angling therefrom of a size effective to snap into place in the tubular through the slots with its central portion being supported by the upwardly facing stop means and the arms engaging the inside walls adjacent these slots is provided. The spring band shaped anchor has portions extending upwardly and outwardly of the tubular body which engage and dig into the wellbore wall thereby securely anchoring the anchor and hence the explosive charge against upper movement in the wellbore.

A groove is provided in the side wall of the body and extends downwardly and into the central portion of the body's lower end which is closed with a closure member. Means are provided on the lower end of the tubular member to secure it to the upper end of the cylindrical container containing the explosive charge and is so arranged that the closed lower end is closely adjacent to the upper end of the explosive charge thereby maintaining the detonator, such as a blasting cap in the explosive charge.

For those containers having interrupted threads, the securing means on the tubular member has thread barriers which snap and lock into place in the spaces provided by the interruption of the threads.

A more detailed description of the seismic explosive charge loader and anchor will be found under the heading "Description of Presently Preferred Embodiments."

Accordingly, it is an objection of the present invention to provide a relatively inexpensive seismic explosive charge loader and anchor which effectively anchors explosive charges in a borehole against unauthorized and malicious removal therefrom.

A further object of the present invention is the provision of a seismic explosive charge loader and anchor which securely locks to the available form of explosive charge containers currently on the market.

A further object of the present invention is the provision of such a seismic explosive charge loader and anchor in which the anchor wing of the explosive charge loader and anchor snaps securely in place therein giving great stability to anchoring the charge in the shothole and which prevents floating charges and deters malicious and unauthorized removal of the charge from the shothole.

Other and further objects, features and advantages of the invention appear throughout.

BRIEF DESCRIPTION OF THE DRAWINGS

FIG. 5 is a side elevational view of the body of the seismic anchor and loader.

FIG. 6 is a cross-sectional view taken along the line 6—6 of FIG. 5.

FIG. 7 is a fragmentary elevational view of the upper portion of a cylindrical container for explosive charges illustrating interrupted threads on the container.

FIG. 8 is a top view taken along the line 8—8 of FIG. 7 looking downwardly into the cylindrical container.

DESCRIPTION OF PRESENTLY PREFERRED EMBODIMENTS

Figure 1:
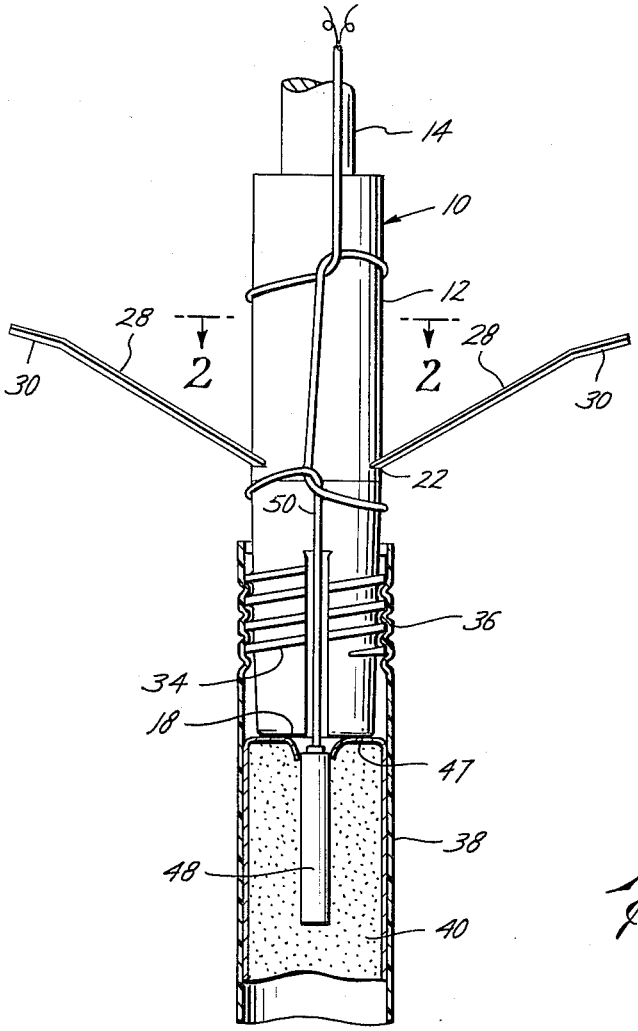
FIG. 1 is a side elevational view, partly in section, illustrating the seismic explosive charge loader and anchor shown securely locked to a cylindrical container housing an explosive charge.
Figure 4:
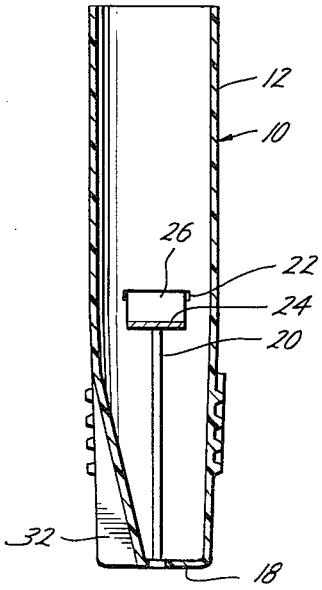
FIG. 4 is a sectional view taken along the line 4—4 of FIG. 2.
Figure 2:
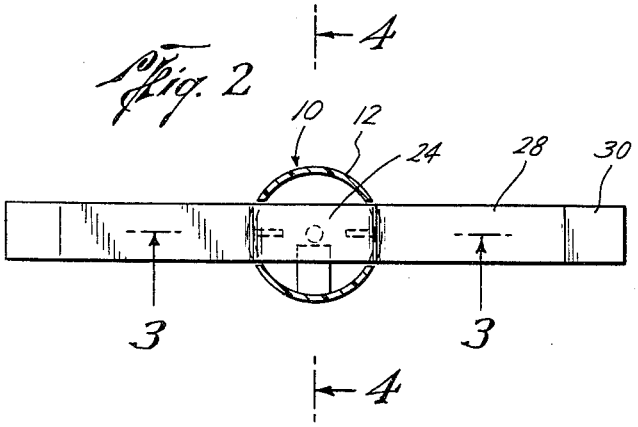
FIG. 2 is a cross-sectional view taken along the line 2—2 of FIG. 1.

Referring now to the drawings, and particularly to FIGS. 1, to 4, the combination seismic explosive charge loader and anchor is generally indicated by the reference numeral 10 and comprises a generally tubular body 12 open at its upper end 12 providing an upwardly facing recess having an internal diameter sufficient to loosely receive a loading means, such as the loading pole 14.

Upwardly facing stop means 16 are provided intermediate the upper end 12 and the lower end 18 of the body 12 and, preferably, these are formed by the upper end of ribs 20 which extend downwardly along the inner wall of the tubular body 12 to provide support for the body and the upwardly facing shoulders 16.

Figure 3:
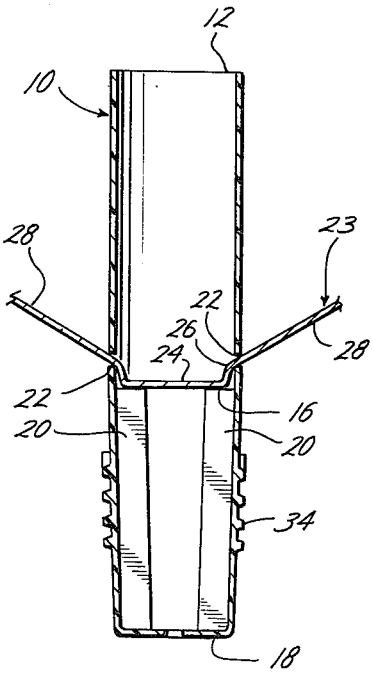
FIG. 3 is a sectional view taken along the line 3—3 of FIG. 2.

A pair of transversely opposed slots 22 are provided in the body adjacent the stop means 16 through which a spring band anchor 23 having a central portion 24 with the arms 26 angling therefrom, the central portion 24 and the arms 26 being of a size effective to snap into place in the tubular body 12 with the central portion 24 being supported by the upwardly facing shoulders 16 and the arms 26 engaging the inside wall of the body 12 adjacent the slots 22, as best seen in FIG. 3.

The spring band shaped anchor has the portions 28 which extend upwardly and outwardly exteriorly of the tubular body 12 and which are effective to engage and dig into the well bore earth formation wall, not shown, to thereby anchor the combination loader and anchor 10 against upward movement in the well bore. Preferably, the upwardly extending arms 28 terminate in outwardly extending end portions 30 which effectively dig into the earth wall formation of the well bore, not shown. This arrangement provides great stability for the anchor and makes it difficult for unauthorized and malicious removal of the explosive charge secured to the loader and anchor 10 from the well bore, not shown.

The body 12 is provided with a groove 32 in its side wall which extends downwardly and inwardly into a central portion of the lower end 18 of the tubular body, which lower end 18 is a closure member for the purpose subsequently set forth. The slot 32 is for the purpose of receiving an electrical lead as will be described subsequently.

Means, shown as the threads 34, are provided adjacent the lower end 18 on the tubular body 12 for securing it by the cooperating securing means 36 at the upper end of the cylindrical container 38 housing the explosive charge 40.

As best illustrated in FIGS. 5, 7 and 8 the securing means, 36 is here shown as the interrupted threads 42 disposed in the upper end of the cylindrical container 38, which has a certain resiliency, housing the explosive charge 40 (not shown in these views). The interrupted threads 42 provide the spaces 44 between them and the thread barriers 46 and 46*a* are provided on the threads 34 which snap into place in the spaces 44 between the interrupted threads 42 on the cylindrical container 38 thereby snap locking the combination loader and anchor 10 to the cylindrical container 38 housing the explosive 40.

As best shown in FIG. 5, and also shown in FIG. 6, the thread barrier 46 extends the complete length of the threads 34 and the thread barrier 46*a* extends upwardly from the uppermost of the threads 34. Thus, the thread barrier 46 snaps past the threads 42 into the spaces 44 between them due to the resiliency of the cylindrical container 38 until the upper thread barrier 46*a* snaps into a space 44 as the connection is completely made up, thus locking the anchor 10 to the cylindrical container housing 38.

As best seen in FIG. 1, and one aspect of the present invention, is that the means 34 and 36 for securing the tubular body 12 to the cylindrical container is arranged so that the bottom closure member 18 on the lower end of the tubular body 12 of the combination loader and anchor 10 is located closely adjacent or engages either the upper end 47 of the container 38 on the explosive charge 40 for the purpose of securely holding a detonator, such as the blasting cap 48 in place in the explosive charge 40 to insure detonation of the explosive charge 40 at the proper and desired time.

The tubular body 12 preferably is formed of high impact plastic, such as a high density polyethylene, which high density plastic is readily available on the market, such as 9016 HDP from Amoco Oil; 9016 HDP from Gulf Oil Co.; HHM 5502 HDP from Phillips Petroleum; and BMNTRA 80 HDP from Morlex. Preferably, the combination seismic charge loader and anchor is molded from these materials, which withstand the conditions of use, that is, high impact and from subzero to hot temperatures, as well as being light weight. The spring anchor is formed of a suitable spring steel or other spring metals which will flex and retract as the combination loader and anchor 10 is lowered in the well bore but yet will engage and dig into the earth formation of the well bore when the anchor is attempted to be raised.

Most of the cylindrical containers 38 are fabricated from plastic materials and have a certain resiliency, such as explosive charge containers obtained from Abco-Stone.

In using the combination loader and anchor 10, the spring band anchor 23 is inserted through the slots 22 in the tubular body 12 and snapped into place, as illustrated in FIG. 3. A dynamite punch, not shown, is used to punch a hole in the upper end 47 of the explosive charge 40 and the detonator or blasting cap 48 attached to the lead 50 is inserted into the top of the explosive charge 40, as illustrated in FIG. 1. The lead 50 is placed in the slot 32 of the tubular body 12 which is then threaded into the upper end of the cylindrical container 38 housing the explosive charge 40, as illustrated in FIG. 1. The snap locking device can be heard to click as the combination loader and anchor is so threaded and, preferably, is threaded until the lower end 18 actually engages the upper portion 47 of the explosive charge package 40, which thereby securely maintains the detonator or blasting cap 48 in place to insure detonation of the explosive charge 40 and then ordinarily in practice two half hitches of the lead are made around the tubular body 12, as shown in FIG. 1. The combination loader and anchor 10 with the explosive charge 40 in the container 38 is then ready to be pushed down into the bore hole, not shown. This is accomplished by the loading pole 14, a series of which extend to the surface and are added as the loader and anchor is pushed downwardly into the hole while, at the same, paying out the lead 50. The combination loader and anchor 10 is then pushed down by the loading poles 14 until it is in the best or desired shooting media. The anchor 23 gives great stability in securely anchoring the explosive charge 40 in the well bore, not shown, and prevents it from floating to the surface and deters malicious and unauthorized removal of the charge from the bore hole. Also, the detonator or blasting cap 48 and explosive charge 40 are protected from the weight of the loading poles 14 or other loading means. The common practice of puncturing the side wall of the cylindrical container 38 to insert a blasting cap is eliminated, and having the lead on the outside of the cylindrical container 38 is eliminated which in turn reduces possible lead and detonator damage, reduces side wall friction, and insures a good detonation of the explosive charge 40.

The present invention, therefore, has the advantages and features and accomplishes the objects and ends mentioned as well as others inherent therein.

While a presently preferred embodiment of aspects of the invention has been illustrated and described for purposes of disclosure, changes can be made therein which are within the spirit of the invention as defined by the scope of the appended claims.

What is claimed is:

1. A sesimic explosive charge loader and anchor for loading and anchoring in a bore hole an explosive charge in a generally cylindrical container, comprising, a generally tubular body open at its upper end, the tubular body having outside and inside walls and having an internal diameter sufficient to loosely receive a loading means, upwardly facing stop means intermediate the ends of the tubular body and extending inwardly from the inside wall, the body provided with opposed slots adjacent to the stop means, a spring band shaped anchor having a central portion with arms angling therefrom, both of a size effective to snap into place in the tubular body through the slots with the central portion being supported by the upwardly facing stop means and the arms engaging the inside walls adjacent the slots, the spring band shaped anchor having portions extending upwardly and outwardly exteriorly of the tubular body effective to engage and dig into the well bore wall and thereby anchor the loader and anchor against upward movement in the well bore, the body having a groove in its side wall beginning above and extending downwardly and into the central portion of the tubular body's lower end, and means on the tubular member adjacent the lower end thereof for securing the tubular member to the cylindrical container containing the explosive charge, whereby the loader and anchor can be connected to the cylindrical container containing the explosive charge, the spring band shaped anchor snapped into place in the tubular body through the slots, a lead can be provided extending in the groove and downwardly into the cylindrical container, and the loader and anchor can then be pushed downwardly into the bore hole by the loading means and anchored against upward movement therein.

2. The invention of claim 1, where, the upwardly facing stop means for supporting the spring band shaped anchor are formed by upper ends of a plurality of support ribs disposed and extending downwardly on the tubular body's inside wall.

3. The invention of claim 2 where, the body is molded of a plastic material.

4. The invention of claim 1 where, the spring band anchor portions which extend upwardly and outwardly of the tubular body terminate in outwardly extending end portions effective to dig into the well bore wall.

5. The invention of claim 4 where, the body is molded of a plastic material.

6. The invention of claim 1 including, an inwardly extending bottom closure member on the lower end of the tubular body, and where the means for securing the tubular body to the cylindrical container is arranged so that the bottom closure member is closely adjacent to the explosive charge's upper end and thereby maintains a detonator in place in the upper end of the explosive charge.

7. The invention of claim 6 where, the upwardly facing stop means for supporting the spring band shaped anchor are formed by upper ends of a plurality of support ribs disposed and extending downwardly on the inside wall of the tubular body's inside wall.

8. The invention of claim 6 where, the spring band anchor portions which extend upwardly and outwardly of the tubular body terminate in outwardly extending end portions effective to dig into the well bore wall.

9. The invention of claim 1 or 6 where, the means for securing the tubular member to the cylindrical container comprises threads having at least one thread barrier on the lower end of the tubular body arranged to be threaded into interrupted threads on the cylindrical container with the thread barrier located in a space between the interrupted threads effective to snap lock the lower end of the tubular body and the cylindrical container together.

10. The invention of claim 9 where, the upwardly facing stop means for supporting the spring band shaped anchor are formed by upper ends of a plurality of support ribs disposed and extending downwardly on the inside wall of the tubular body's inside wall.

11. The invention of claim 9 where, the spring band anchor portions which extend upwardly and outwardly of the tubular body terminate in outwardly extending end portions effective to dig into the well bore wall.

12. The invention of claim 9 where, the body is molded of a plastic material.

* * * * *